US006003421A

United States Patent [19]

Milich

[11] Patent Number: 6,003,421

[45] Date of Patent: Dec. 21, 1999

[54] APPARATUS AND METHOD FOR CUTTING ELONGATED WEBS OF MATERIAL

[76] Inventor: Bruce Milich, 208 Farmsedge Rd., Neshanic, N.J. 08853

[21] Appl. No.: 08/911,724

[22] Filed: Aug. 15, 1997

[51] Int. Cl.[6] ..... B26D 5/08

[52] U.S. Cl. ..... 83/564; 83/582; 83/13; 83/56; 242/527.4

[58] Field of Search ..... 83/563, 564, 582, 83/614, 606, 634, 347, 13, 56; 242/527.2, 527.3, 527.4

[56] References Cited

U.S. PATENT DOCUMENTS

| | | | |
|---|---|---|---|
| 2,620,993 | 12/1952 | Jeffrey, Jr. | 83/614 X |
| 3,245,302 | 4/1966 | Bayley | 83/614 |
| 4,015,498 | 4/1977 | Mallory et al. | 83/564 |
| 4,016,786 | 4/1977 | Korner | 83/347 |
| 4,094,217 | 6/1978 | Exline | 83/563 X |
| 4,382,396 | 5/1983 | Hawkins | 83/564 X |
| 4,406,196 | 9/1983 | Roncato et al. | 83/347 |
| 4,506,576 | 3/1985 | Crawford et al. | 83/564 X |
| 4,823,665 | 4/1989 | Cavagna | 83/563 X |
| 4,934,236 | 6/1990 | Gordon | 83/563 |
| 5,312,058 | 5/1994 | Brandt et al. | 83/614 X |
| 5,357,831 | 10/1994 | Machalik | 83/347 |
| 5,520,352 | 5/1996 | Prix et al. | 242/527.3 |

*Primary Examiner*—M. Rachuba
*Attorney, Agent, or Firm*—Patrick J. Pinto

[57] ABSTRACT

A knife assembly 10 for transversely severing at least one elongated web of material including: a sharpened blade member 12, a blade holder 14, a blade holder support assembly 16, an adjustable biasing member 18, a carriage assembly 20, and a backing member 44. The blade member 12 and the blade holder 14 are removably retained in the support assembly 16 by a quick release pin 26. The support assembly 16 is attached to the biasing member 18 by way of a swivel connection 32, The biasing member maintains abutment of the sharpened edge of the blade 12 with the backing member 44 during the cutting operation. A self-orienting assembly maintains the blade 12 in a preferred orientation with respect to the carriage assembly 20 during any period that the blade 12 is not abutting the backing member 44. The cutting assembly 10 is also capable of cutting moving material and simultaneously winding the leading end of the severed material on a cylindrical core that also acts as the backing member 44.

17 Claims, 5 Drawing Sheets

APPARATUS AND METHOD FOR CUTTING ELONGATED WEBS OF MATERIAL

BACKGROUND OF THE INVENTION

1. Field of the Invention

With regard to the classification of art, this invention is believed to be found in the general class entitled Winding Tensioning And Guiding and more particularly to those subclasses pertaining to the Transverse Cutting Of Material During Convolute Winding or Unwinding.

2. Description of Related Art

Transverse cutting of elongated material is well known in the art. Most of the known apparatus and methods for use in the transverse cutting of material being wound or unwound is very elaborate. It has been determined that there is a need for a relatively inexpensive user friendly transverse cutter that may be incorporated into a newly designed winding or unwinding stands. This needed or desired transverse cutter should also be adapted for retrofitting into existing winding or unwinding stands. This needed transverse cutter should be also capable of cutting various webs of materials or laminates of materials such as; paper, paperboard, metallic foils, honeycomb material, filament reinforced materials, woven fabric, non-woven fabrics, linoleum, oriented films, brittle films and the like. The needed transverse cutter should also be capable of reliably cutting webs of material that have a thickness between 12.5 microns (0.0005 inch) and the neighborhood of 3.18 mm (0.125 inch). The needed transverse cutter should also be capable of reliably cutting webs of plastic material that have bead or zipper types of closures formed therein. The needed cutter should also be safe to use while being easy to service and maintain. Other identified needs include ease of replacement of the cutting blade for minimizing down time.

SUMMARY OF THE INVENTION

The above identified needs may also be described as objects of the invention. The present invention solves the above identified needs while simultaneously providing a cutting apparatus that substantially eliminates unwanted fold-over of the material as the cut is made.

The present invention may also be briefly described as: a knife assembly for severing at least one web of an elongated flexible material comprising: a) a blade member having at least one sharpened edge; b) a blade holder that is configured for removably retaining the blade member therein, the blade holder is also configured for exposing a selected portion of the sharpened edge; c) a blade holder support assembly is configured for removably supporting and retaining the blade holder in a predetermined orientation, the blade holder support assembly further includes a retaining means, such as a quick release pin, for allowing a quick release of the blade holder from the blade holder support assembly; d) an adjustable biasing means, such as a pneumatic cylinder, is configured for mounting the blade holder support assembly by way of a swivel means, the swivel means is configured for allowing rotation of the blade holder support assembly about a longitudinal axis passing through one end of the adjustable biasing means; e) a carriage assembly is arrayed for carrying the adjustable biasing means thereon, the carriage assembly is adapted for a selective linear movement that is in a direction transverse to at least one elongated edge of the flexible material, the selective linear movement is provided by a linear actuator that travels between a first position and a second position; (f) a first actuator means for selectively moving the blade holder support assembly to and away from a backing member, the backing member is elongated while being disposed on a side of the flexible material that is opposite to the blade holder support assembly; (g) and a self orienting means; wherein the blade member is first moved toward the backing member by the first actuator means, then subsequently moved transverse to the flexible material by the carriage assembly thereby severing the flexible material while simultaneously abutting with the backing member, the adjustable biasing means provides a selected biasing pressure for maintaining abutment of the sharpened edge with the backing member, the first actuator means retracts the blade member away from the backing member, and the self orienting means positions the blade member in a selected alignment with respect to the direction of linear movement of the carriage assembly prior to and after the abutment with the backing member by the sharpened edge of the blade member.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode for the present invention. These specific embodiments, as shown in the accompanying drawings, may also include diagrammatic symbols for the purpose of illustration and understanding.

Figure 1:
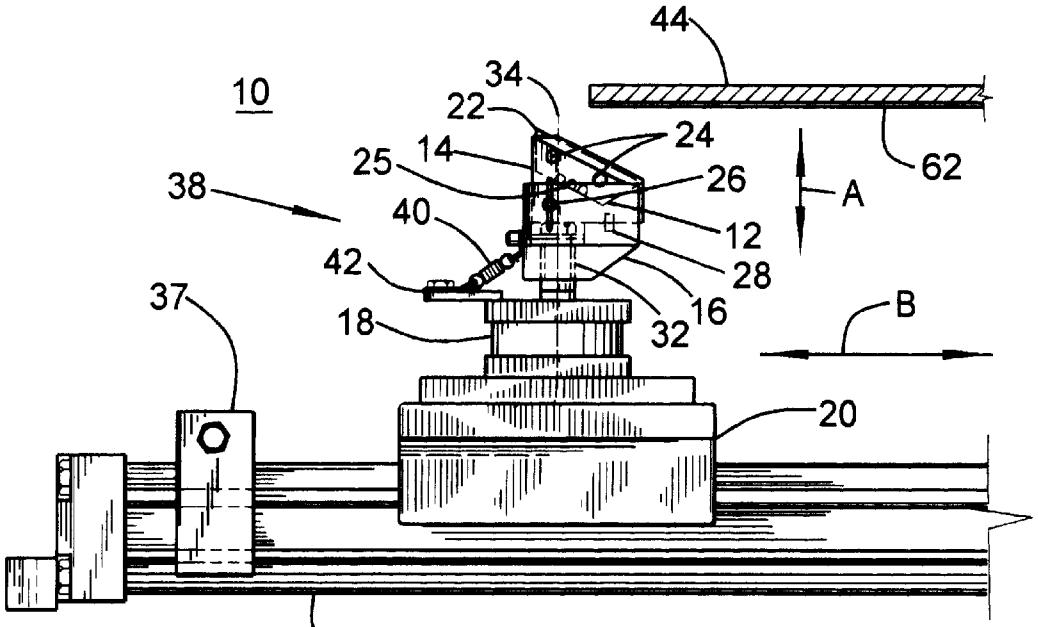
FIG. 1 represents a front elevation of a cutting apparatus of the present invention. This view showing a fragmentary portion of one end of a linear actuator and a backing member.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
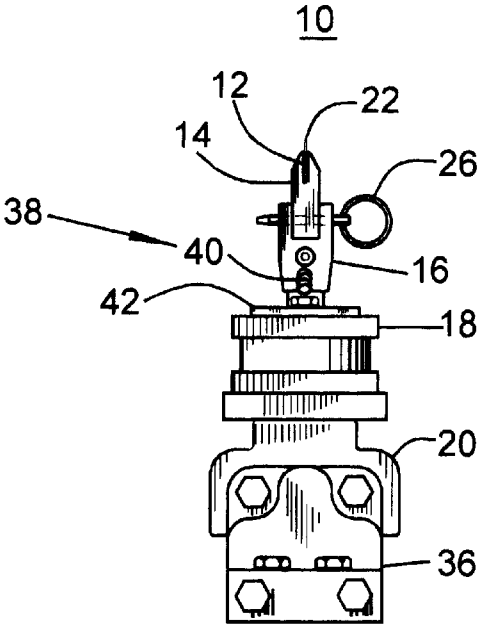
FIG. 2 represents a side elevation of the cutting apparatus.

Referring first to FIGS. 1 and 2, one embodiment of the cutting apparatus assembly is generally identified as 10. This embodiment of the cutting apparatus assembly 10 includes a blade member 12, a blade holder 14; a blade holder support assembly 16, an adjustable biasing means 18; and a carriage assembly 20.

The blade member 12 includes at least one sharpened edge 22. The blade member 12 is removably retained and positioned in the blade holder 14 so that a selected portion of the sharpened edge 22 is exposed for cutting an elongated web of a selected material. The sharpened edge 22 of the blade member 12 is mounted at a predetermined cutting angle with respect to a horizontal plane. For example a cutting angle between the range of 25 degrees and 35 degrees provides good results when using a standard utility blade as the blade member 12. The use of a standard utility blade is preferred, due to its commercial availability and cost, but is not limited thereto. It is also to be understood that other cutting angles may be required with other types of blade members 12.

The preferred blade holder 14 is depicted as being manufactured from a unitary piece of material such as aluminum. The blade member 12 is removably retained in a slot formed in the blade holder 14 by at least one fastener 24 such as a socket head setscrew. It has been found that the blade member 12 is reliably retained in the blade holder 14 by using two setscrews 24 in combination with a locating pin or key 25. Alternatively, if the blade holder 14 is made of multiple pieces, then at least one countersunk head screw would be used for clamping the blade member between the pieces.

The blade holder 14 is removably supported and retained in the blade holder support assembly 16. It is preferred that a quick release pin 26 be used for removably retaining the blade holder 14 in the blade holder support assembly 16 but not limited thereto. A quick release pin 26 is preferred because inspecting or changing of the blade holder 14 and blade member 12 assembly may be performed, as a modular assembly, without using tools. It is anticipated that a second blade holder 14 with a sharpened blade 12 retained therein is on hand for immediate replacement, otherwise tools would be needed for releasing the blade member 12 from the blade holder 14. Down time would be minimized by having the second or spare blade holder on hand. It is also preferred that a locating means 28 be also provided for positioning the blade holder 14 in the blade holder support assembly 16. Examples of a locating means are dowel pins, spring pins, and the like cooperating with a matching aperture, but not limited thereto. The combination of the locating means 28 and the quick release pin 26 limit the retention of the blade holder 14 to a single preferred position.

The blade holder support assembly 16 is supported by an adjustable biasing means 18. Some examples of adjustable biasing means 18 are pneumatic cylinders, pneumatic bellows, pneumatic springs, mechanical springs and the like. One example of an adjustable biasing means 18 is a pneumatic cylinder having a 5.08 cm (2 in.) bore and operating within a pneumatic line pressure range between 10 and 15 PSIG. A pneumatically operated biasing means 18 is preferred because the biasing pressure may be remotely adjusted by a pressure regulator and selectively actuated, in the direction of arrow A, by and with a control valve.

The blade holder support assembly 16 is attached to the adjustable biasing means 18 by way of a swivel connection means 32. This swivel connection 32 allows rotation of the blade holder support assembly 16 about the longitudinal vertical axis 34 of the adjustable biasing means 18. The swivel connection 32 may include anti-friction means such as a bushing, a bearing or the like in association with a retaining means such as a retaining ring, headed fastener and the like. It is preferred that the exposed cutting tip of the blade member 12 be displaced a selected distance from the longitudinal axis 34 in a range between 6 mm. and 12 mm. for providing a caster-like action.

The adjustable biasing means 18 is carried by and on the carriage assembly 20. This carriage assembly 20 is adapted for linear movement in a direction of arrow B, that is substantially transverse to an elongated edge of any material being cut. The linear movement is provided by a linear actuator 36. It is preferred that a pneumatic linear actuator such as a commercially available rodless cylinder or band cylinder be used. By way of example, a Tol-O-Matic™ Model BL215 has been found to provide the necessary speed and force for normal cutting applications, but not limited thereto. A rodless linear actuator is preferred due to its overall compactness, weight, and mounting convenience. It is also preferred that a stop member 37 be mounted on each end of the linear actuator 36. The stop members 37 should be adjustable for limiting the linear movement of the carriage assembly 20 to within a predetermined range. The stop members 37 may further include a sensing means for sending signals to a control system.

A self orienting means 38 is provided for positioning the blade member 12 in a selected alignment with respect to the direction of linear movement of the linear actuator 36, as and when the blade member 12 is not cutting material. The self orienting means includes a biasing means such as an extension spring, torsion spring, compression spring, ball detent and the like. One example of the self orienting means 38 and its mounting arrangement is depicted in FIGS. 1 and 2, but not limited thereto. In this non limiting example, one end of the extension spring 40 is attached to the blade holder support assembly 16 and the other end is connected to a bracket 42 that is fastened to a selected portion of the adjustable biasing means 18. As an additional example, it is anticipated that a torsion spring may have its coiled portion piloted on a piston rod bushing of a pneumatically operated adjustable biasing means 18, while having one end engaging the blade holder assembly 16 and its other end engaging a selected portion of the adjustable biasing means.

An elongated backing member 44 is mounted on a side of a material to be cut that is opposite to the blade holder 14. It is preferred that the length of the backing member 44 be at least equivalent to the total width of the material being cut. The major axis of the backing member 44 should be substantially parallel to the direction of travel of the linear actuator 36. This backing member 44 should also be of a material that will allow penetration by the sharpened edge 22 therein. It has been found that using a standard core as a backing member 44 provides an economical way for meeting the criteria for a backing member while minimizing the waste of resources. In some applications for unwinding apparatus, one core may be used several times before replacement is necessary.

Figure 3:
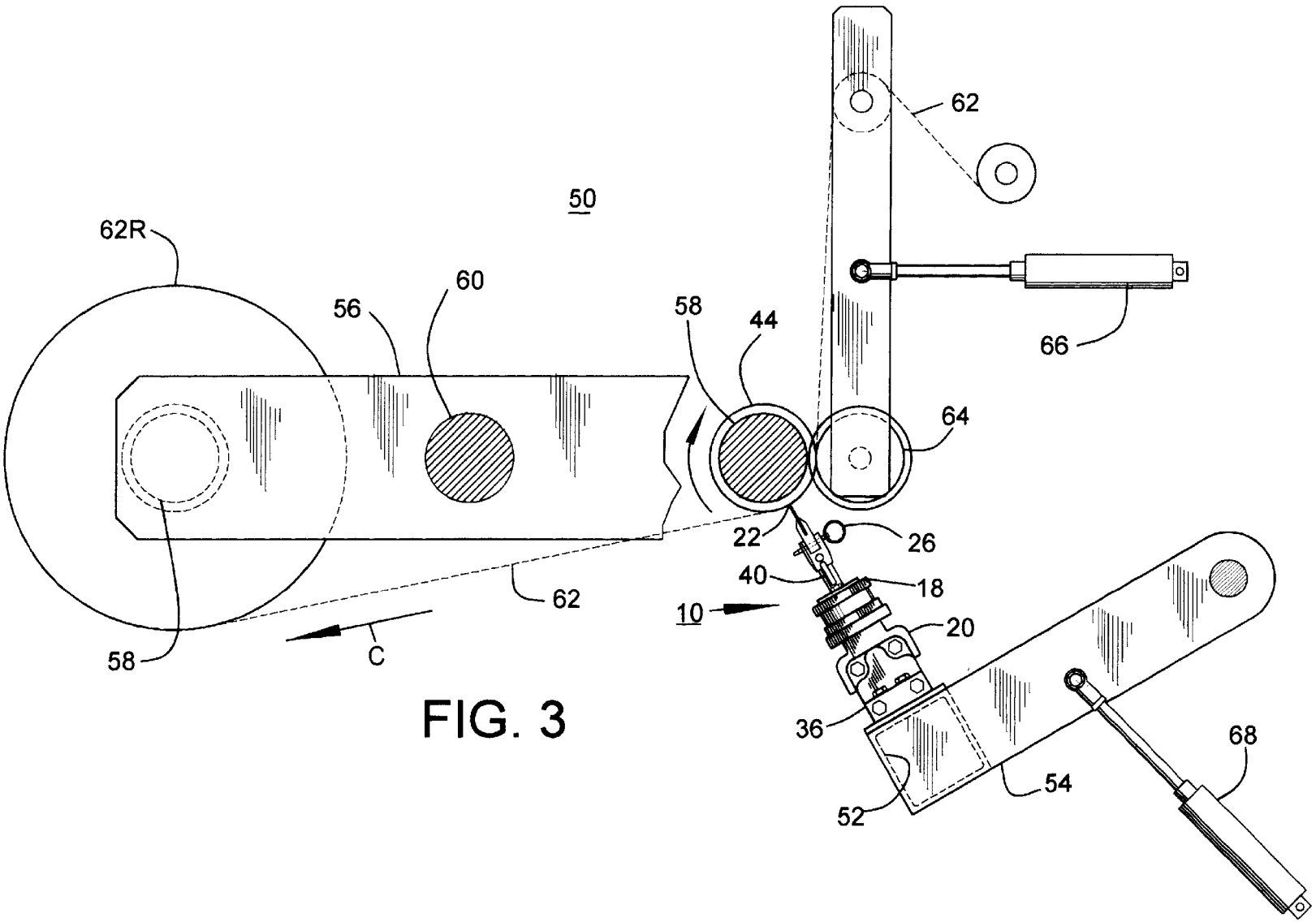
FIG. 3. represents a side elevation of a turret winder with the cutting apparatus of the present invention shown in a cutting position. This view being partly diagrammatic and showing a portion of the turret arm being broken away for clarity of the illustration.
Figure 4:
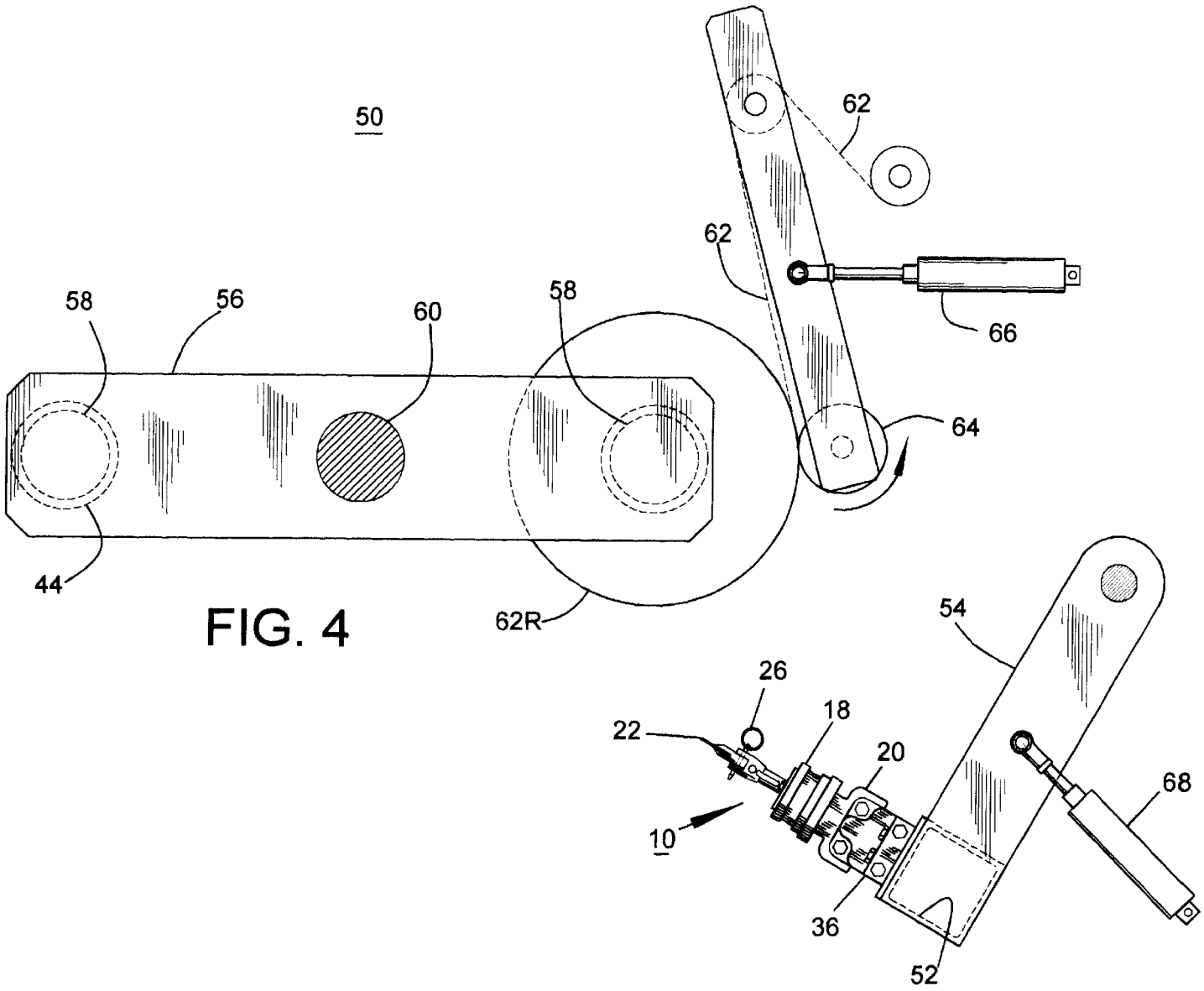
FIG. 4 represents a side elevation, partly diagrammatic, of a turret winder with the cutting apparatus of the present invention shown in a retracted position.

Referring now to FIGS. 3 and 4, the cutting apparatus 10 of present invention is shown in use with a turret winder 50. In this application the cutting apparatus 10 is removably fastened to a cross member 52 of a pivoting arm assembly 54. The pivoting arm assembly 54 is pivotally attached to a frame, not shown, of the turret winder 50. This turret winder 50 further includes a turret arm 56 that is shown as having two winding mandrels 58 rotatably carried thereon. The turret arm 56 is attached to the frame by a turret shaft 60.

Referring in particular to FIG. 4, a first of the mandrels 58, shown on the right, holds a cylindrical core having an elongated web of material 62 being wound thereon thereby forming a roll of material 62R. A bump or lay-on roller 64 lays the material on the roll during the winding operation. A pneumatic cylinder 66 applies a predetermined winding pressure to the lay-on roller 64. The cutting apparatus 10, is now shown in a retracted position. A second linear actuator 68 is used for positioning the pivot arm assembly 54 with the cutting apparatus 10 mounted thereon at the retracted position , as shown in FIG. 4, or at a cutting position, as shown in FIG. 3. An empty core is placed on the second mandrel 58 while the roll of material 62R is being wound. This empty core will be used as a backing member 44. It is to be noted that in some applications, a pneumatic adjustable biasing means 18 and the second linear actuator may be one and the same. This may be the case where distances of travel from a cutting position to a retracted position are relatively short. It is to be further noted that the adjustable biasing means 18 maintains contact with the backing member 44 while compensating for any manufacturing tolerances.

Figure 5:
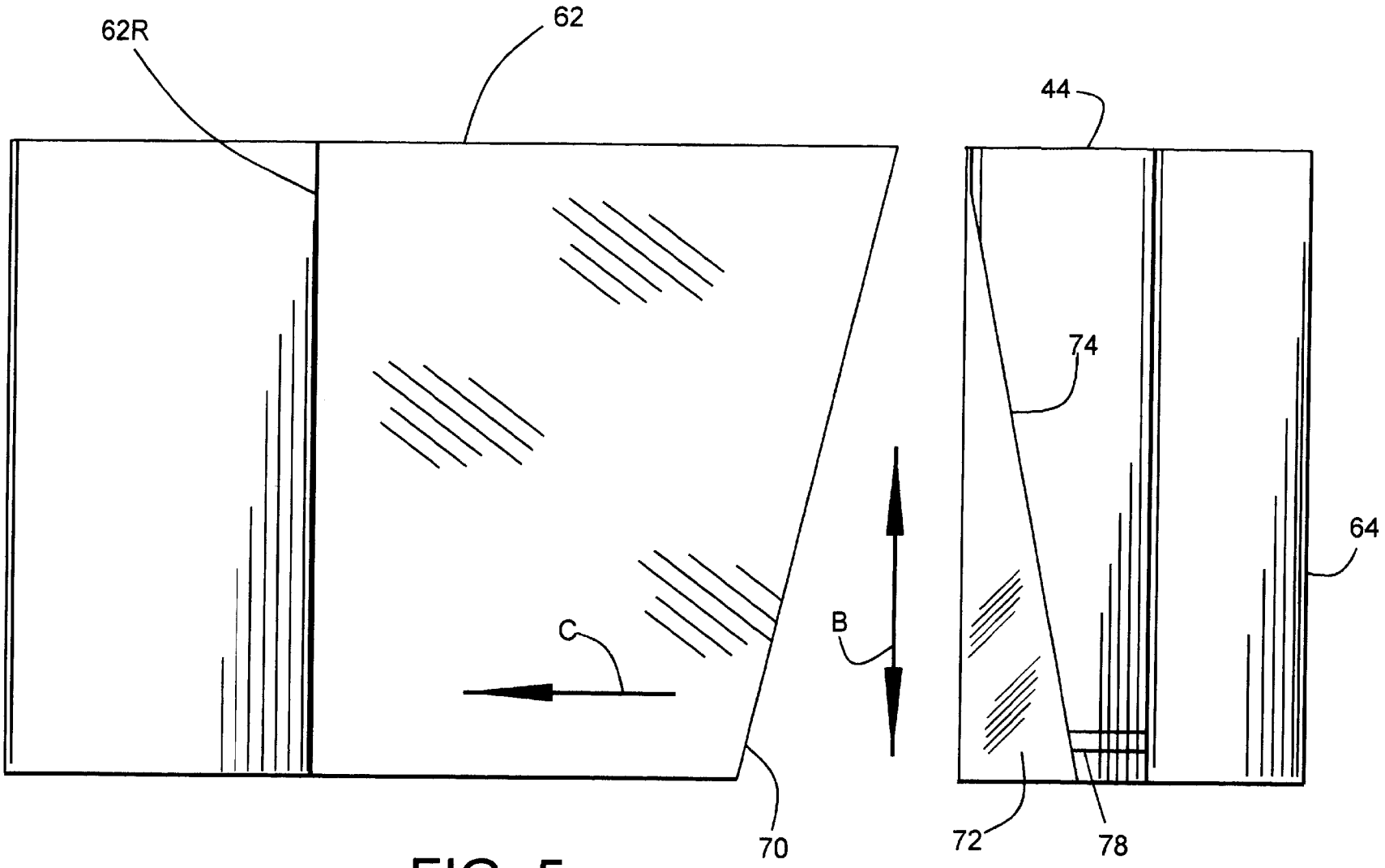
FIG. 5 represents a fragmentary top elevation of the web of material depicted in FIG. 3, showing the material after being cut and with a second portion of the cut material being wound onto an empty core.

Referring now to FIG. 3, the turret arm 56 of the turret winder 50 has been indexed 180 degrees after a predetermined quantity of material 62 has been wound on the roll of material 62R. The empty core, acting as the backing member 44, is in the roll winding or right hand position. The bump roller 64 is moved against the empty core/backing member 44. After a signal is received from the turret winder 50, the cutting apparatus is first moved to the cutting position. The linear actuator 36 subsequently moves the blade member 12 transverse to the direction of travel of material 62. The material is cut into a first portion 70 and a second portion 72, which is more clearly seen in FIG. 5. The first portion continues to travel in the direction of arrow C for winding on the roll of material 62R. The second portion 72 is wound onto the combined empty core and backing member. The leading edge 74 of the second portion 72 is cut at an angle other than ninety degrees to the sides of the material. The angle of the cut is dependent on the combination of the speed of the material 62 moving past the cutting apparatus 10 and the speed of the linear actuator 36. Some materials have been found to have an inherent attraction for the core thereby enabling winding. Alternatively, it may be necessary for an operator to apply an attaching means 78 such as a strip of double sided tape, a sticky coating and the like to the core before its placement on the winding mandrel 58.

Figure 6:
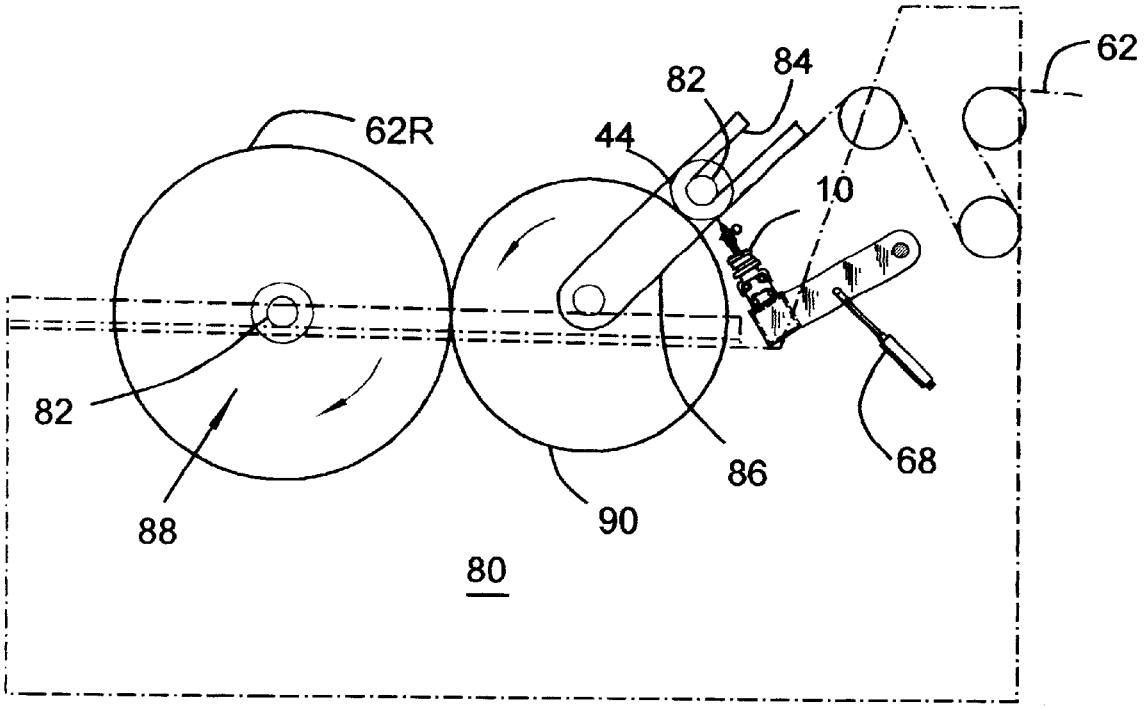
FIG. 6 represents a front elevation, partly diagrammatic, of a surface winding apparatus with the cutting apparatus of the present invention mounted thereon.

Referring now to FIG. 6, the cutting apparatus 10 of the present invention may be mounted to a surface winding machine, generally identified as 80. In this alternate application, an empty core and backing member 44 is placed onto a mandrel 82. The empty core and mandrel 82 assembly is placed into a pair of open ended elongated apertures 84 at the one end of a pair of arms 86 while a roll of material 62R is being formed at a winding station 88 of the winding machine 80. After a predetermined quantity of material is wound on the roll of material 62R, a signal is sent to actuate the cutting apparatus 10. Simultaneously, the core contacts the winding drum 90 and the cutting apparatus severs the material 62 to begin the formation of a new roll of material. The material 62 is cut with a first portion being wound onto the roll of material 62R. A leading edge of the second portion is attached to the empty core. As the fully wound roll of material 62R exits the machine, the arms 86 are rotated counter-clockwise carrying the empty core and leading edge thereon to the winding position. After the new roll reaches a predetermined diameter, and the mandrel clears the elongated aperture, the arms 86 are returned to the position shown in FIG. 6, by clock-wise rotation.

Figure 7:
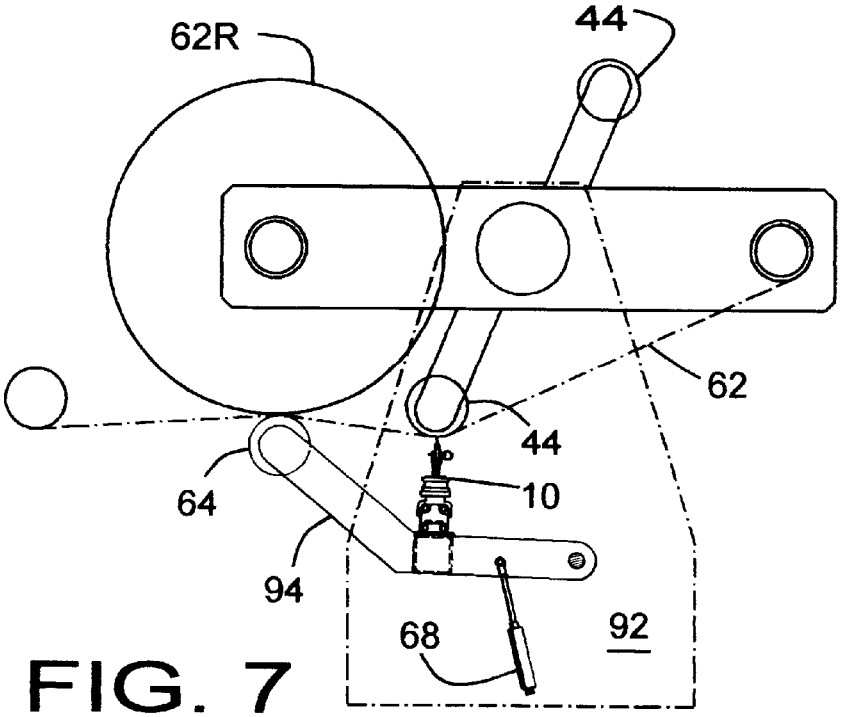
FIG. 7 represents a front elevation, partly diagrammatic, of a turret unwinding apparatus with the cutting apparatus of the present invention mounted thereon.

A third application for the cutting apparatus 10 is depicted in FIG. 7. This third application is associated with a turret unwinding apparatus 92. The operation of a turret unwinding apparatus 92 is similar to turret winder apparatus 50 except a roll of material 62R is unwound in a substantially continuous operation. The operation is substantially reverse to the operation of the turret winder 50 described above. The cutting apparatus 10 and the bump roll 64 of this application are shown as being carried on a pair of pivot arms 94. The pivot arms 94 are shown in a cutting position. The arms 94 are moved between a retracted position, not shown and the cutting position by the pneumatically operated second linear actuator 68.

The cutting apparatus of the present invention cuts materials that are in contact with a rotating backing member or core 44. The present invention can accommodate the cutting of the material without fold-over on the winder. A variety of materials or laminates thereof may be cut. The present invention has successfully cut materials such as paper, paperboard, metallic foils, films, woven material, non-woven material, reinforced materials, honeycomb structures, oriented material, brittle material and the like. It has been found that the present invention can cut a total width of material or multiple webs of materials in the vicinity of 5.08 meters (200 inches) and line speeds in the vicinity of 909 meters/min.

As previously mentioned above, the present invention is economical and reliable while being adaptable to installation into newly designed equipment as well as a retrofit into existing equipment. Of course reliability is dependent on a sharpened blade member 12 and a properly operating and tuned control and actuating system.

It is anticipated that a laser or a water jet cutting device may be substituted for the blade member 12. Of course the blade holder 14 would need to be modified for mounting the anticipated laser or the water jet cutting device therein and thereon. The general operation of the anticipated apparatus would be similar to that described above in connection with cutting apparatus 10.

The above discussions also suggest a method for severing at least one web of an elongated flexible material including the steps of:

a) selectively urging a sharpened edge of a blade member to and towards a backing member, by selectively actuating a first actuator means in a first direction, said blade member being removably retained in and by a blade holder, with a selected portion of said sharpened edge of said blade member being exposed therefrom, said blade holder being supported by a blade holder support assembly; said blade holder being removably retained in said blade holder support assembly by and with a quick release means;

b) subsequently severing said flexible material by moving a carriage assembly in a first linear direction that is transverse to the elongated edge of said flexible material by actuation of a linear actuator, said carriage assembly being arrayed for removably mounting an adjustable biasing means thereto, said adjustable biasing means being also arrayed for attachment to said blade holder assembly thereby providing a selected severing pressure between said sharpened edge of said blade member and said backing member;

c) disengaging said sharpened edge of said blade member from said backing member after a predetermined length of travel of said carriage assembly in said linear direction by selectively actuating said first actuator means in a second direction that is opposite to said first direction;

e) returning said carriage member to a start position by moving said carriage member in a second linear direction by selective actuation of said linear actuator, said second linear direction being opposite to said first linear direction; and f) controlling the orientation of said blade member with respect to a direction of transverse movement of said blade member during any interval of absence of said abutment of said sharpened edge from said backing member by providing a self orienting means cooperating with a swivel means, said swivel means being provided in an attachment of said blade holder support assembly with said adjustable biasing means;

Directional terms such as "front", "back", "right", "left", "in", "out", "downward", "upper", "lower" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A knife assembly for severing at least one web of an elongated flexible material comprising:

a) a blade member having at least one sharpened edge;

b) a blade holder being configured for removably retaining said blade member therein, said blade holder being further configured for exposing a selected portion of said sharpened edge;

c) a blade holder support assembly being configured for removably supporting and retaining said blade holder in a predetermined orientation, said blade holder further including a retaining means for allowing a quick release of said blade holder from said blade holder support assembly;

d) an adjustable biasing means being configured for mounting said blade holder support assembly by way of a swivel means, said swivel means being configured for allowing rotation of said blade holder support assembly about a longitudinal axis of said adjustable biasing means;

e) a carriage assembly carrying said adjustable biasing means thereon, said carriage assembly being adapted for selective linear movement that is in a direction transverse to at least one elongated edge of said elongated flexible material, said selective linear movement being provided by a first linear actuator that travels between a first position and a second position;

f) a first actuating means for selectively moving said blade holder support assembly to and away from a backing member, said backing member being an elongated rotating cylinder, said backing member being disposed on a side of the elongated flexible material that is opposite to said blade holder;

g) a self orienting means; and wherein said blade member is first moved toward said backing member by said first actuating means, then subsequently being moved transverse to said elongated flexible material by said carriage assembly thereby severing said elongated flexible material while simultaneously abutting with said backing member, said adjustable biasing means providing a selected biasing pressure for maintaining an abutment of said sharpened edge with said backing member, said abutment further providing penetration of said sharpened edge into a surface of said backing member simultaneously as said backing member is rotating and said self orienting means positioning said blade member in a selected alignment with respect to the direction of linear movement of said carriage assembly prior to and after said abutment with said backing member by said sharpened edge of the blade member.

2. An apparatus as recited in claim 1 wherein said adjustable biasing means is a second linear actuator, said second linear actuator being a pneumatic cylinder.

3. An apparatus as recited in claim 2 wherein said self orienting means includes an extension spring, a first end of said extension spring being attached to said blade holder support assembly and a second end of said extension spring being attached to a selected portion of a body of the pneumatic cylinder.

4. An apparatus as recited in claim 3 wherein said blade member is a utility knife blade.

5. An apparatus as recited in claim 2 wherein said blade member is a utility knife blade.

6. An apparatus as recited in claim 2 wherein said swivel means includes a bearing member that connects a piston shaft of said pneumatic cylinder with said blade holder support assembly.

7. An apparatus as recited in claim 6 wherein said self orienting means includes an extension spring, a first end of said extension spring being attached to said blade holder support assembly and a second end of said extension spring being attached to a selected portion of a body of the pneumatic cylinder.

8. An apparatus as recited in claim 1 wherein said self orienting means includes an extension spring, a first end of said extension spring is attached to said blade holder support assembly and a second end of said extension spring is attached to a selected portion of said adjustable biasing means.

9. An apparatus as recited in claim 8 wherein said elongated flexible material is moving past said apparatus in a selected direction that is parallel to the elongated edge; and said backing member is an empty core, said apparatus selectively severs said elongated flexible material into a first portion and second portion, said second portion being simultaneously wound onto and around said rotating empty core.

10. An apparatus as recited in claim 1 wherein said first actuating means and said adjustable biasing means are integrated into a single pneumatic cylinder.

11. A method for severing at least one web of an elongated flexible material including the steps of:

selectively urging a sharpened edge of a blade member to and towards a rotating backing member, by selectively actuating a first actuating means in a first direction, said blade member being removably retained in and by a blade holder, with a selected portion of said sharpened edge of said blade member being exposed therefrom, said blade holder being supported by a blade holder support assembly; said blade holder being removably retained in said blade holder support assembly by and with a quick release means;

subsequently severing said elongated flexible material by moving a carriage assembly in a first linear direction that is transverse to an elongated edge of said elongated flexible material by actuation of a first linear actuator, said elongated flexible web traveling relative to said carriage assembly in a direction that is parallel to the elongated edge, said carriage assembly having an adjustable biasing means removably mounted thereto, said adjustable biasing means carrying said blade holder thereby providing a selected severing pressure between said sharpened edge of said blade member and said rotating backing member, said severing pressure providing a penetration of said sharpened edge into a surface of the rotating backing member;

disengaging said sharpened edge of said blade member from said rotating backing member after a predetermined length of travel of said carriage assembly in said first linear direction by selectively actuating said first actuating means in a second direction that is opposite to said first linear direction;

returning said carriage member to a start position by moving said carriage member in a second linear direction by selective actuation of said first linear actuator, said second linear direction being opposite to said first linear direction; and controlling the orientation of said blade member with respect to a direction of transverse movement of said blade member during any interval of absence of said penetration of said sharpened edge into said rotating backing member by providing a self orienting means cooperating with a swivel means, said swivel means being provided in a connection between said blade holder support assembly and said adjustable biasing means.

12. A method as recited in claim 11 wherein said step of severing said elongated flexible material occurs simultaneously while a selected portion of said elongated flexible material is being wound around said rotating backing member.

13. A method as recited in claim 11 wherein said adjustable biasing means is a pneumatic cylinder.

14. A method as recited in claim 12 wherein said adjustable biasing means is a pneumatic cylinder.

15. A method as recited in claim 13 wherein said self orienting means includes an extension spring, a first end of said extension spring is attached to said blade holder support assembly and a second end of said extension spring is attached to a selected portion of a body of the pneumatic cylinder.

16. A method as recited in claim 14 wherein said self orienting means includes an extension spring, a first end of said extension spring is attached to said blade holder support assembly and a second end of said extension spring is attached to a selected portion of a body of the pneumatic cylinder.

17. A method as recited in claim 11 including the further step of applying an attaching means to the rotating backing member prior to rotation thereof and wherein said rotating backing member is an empty core for winding said elongated flexible material thereon.

* * * * *